US012048411B2

(12) United States Patent
Chichester et al.

(10) Patent No.: US 12,048,411 B2
(45) Date of Patent: Jul. 30, 2024

(54) MODULAR PARTICLE COLLECTION SYSTEM AND RELATED METHODS

(71) Applicant: Battelle Energy Alliance, LLC, Idaho Falls, ID (US)

(72) Inventors: David L. Chichester, Idaho Falls, ID (US); Alexander K. May, Idaho Falls, ID (US); Kevin P. Carney, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 91 days.

(21) Appl. No.: 17/659,935

(22) Filed: Apr. 20, 2022

(65) Prior Publication Data

US 2022/0338692 A1 Oct. 27, 2022

Related U.S. Application Data

(60) Provisional application No. 63/177,704, filed on Apr. 21, 2021.

(51) Int. Cl.

| | |
|---|---|
| ***A47L 9/16*** | (2006.01) |
| ***A47L 5/24*** | (2006.01) |
| ***A47L 9/10*** | (2006.01) |

(52) U.S. Cl.

CPC ..... *A47L 9/1683* (2013.01); *A47L 5/24* (2013.01); *A47L 9/104* (2013.01); *A47L 9/1625* (2013.01); *A47L 9/1666* (2013.01)

(58) Field of Classification Search

CPC .. B01D 45/12–16; B01D 45/00; B01D 45/08; B01D 45/16; B01D 2279/55;

(Continued)

(56) References Cited

U.S. PATENT DOCUMENTS 4,061,480 A * 12/1977 Frye ..... G21F 9/001 55/362
4,726,825 A * 2/1988 Natale ..... A47L 9/127 55/467

(Continued)

FOREIGN PATENT DOCUMENTS

| | | | |
|---|---|---|---|
| CN | 110063688 | * | 5/2019 |
| CN | 209863648 U | * | 12/2019 |
| KR | 100861996 B1 | * | 9/2008 |

OTHER PUBLICATIONS

KR-100861996-B1 espacenet translation (Year: 2023).*
CN-209863648-U espacenet translation (Year: 2023).*
CN 110063688 espacenet translation (Year: 2023).*

*Primary Examiner* — Brian D Keller
*Assistant Examiner* — Tim Brady
(74) *Attorney, Agent, or Firm* — TraskBritt

(57) ABSTRACT

A modular particle collection system includes a hollow lower member, a hollow upper member separably attached to the hollow lower member, a collection container separably attached to a longitudinal end of the hollow lower member opposite the hollow upper member, an inlet portion extending radially from the hollow lower member and configured to be fitted to a first portion of a vacuum system, a particulate filter, and an outlet portion extending radially outward from the hollow upper member and configured to be fitted to a second portion of vacuum system. Additional modular particle collection systems and a method of making a modular collection system are also disclosed.

18 Claims, 7 Drawing Sheets

(58) Field of Classification Search
CPC ..... A47L 9/104; A47L 9/1625; A47L 9/1666; A47L 9/1683; B04C 5/081; B04C 5/185; B04C 5/103
USPC ..... 96/269–271; 15/347; 55/337
See application file for complete search history.

(56) References Cited

U.S. PATENT DOCUMENTS 5,350,432 A * 9/1994 Lee ..... A47L 9/1608 55/408
5,375,293 A * 12/1994 Gilbertson ..... A47L 9/19 55/482
6,766,558 B1 * 7/2004 Matsumoto ..... A47L 9/2821 15/353
6,898,821 B1 * 5/2005 Bisbee ..... A47L 7/0071 15/353
2004/0107530 A1 * 6/2004 Lee ..... A47L 9/122 15/353
2004/0187449 A1 * 9/2004 Witter ..... B04C 9/00 55/337
2004/0237248 A1 * 12/2004 Oh ..... B04C 5/00 15/353
2006/0075899 A1 * 4/2006 Evans ..... B01D 46/24 96/415
2006/0254226 A1 * 11/2006 Jeon ..... B04C 5/24 55/345
2007/0022564 A1 * 2/2007 Witter ..... A47L 9/14 15/353
2007/0251198 A1 * 11/2007 Witter ..... B01D 50/20 55/300
2015/0335217 A1 * 11/2015 Fritsche ..... A47L 5/24 134/10
2017/0020351 A1 * 1/2017 Sjöberg ..... A47L 9/20
2017/0071433 A1 * 3/2017 Millington ..... A47L 5/36
2021/0001356 A1 * 1/2021 Fitzsimmons ..... B04C 5/14
2022/0288518 A1 * 9/2022 Hosur ..... B01D 46/0046

* cited by examiner

MODULAR PARTICLE COLLECTION SYSTEM AND RELATED METHODS

CROSS-REFERENCE TO RELATED APPLICATION

This application claims the benefit under 35 U.S.C. § 119(e) of U.S. Provisional Patent Application Ser. No. 63/177,704, filed Apr. 21, 2021, the disclosure of which is hereby incorporated herein in its entirety by this reference.

STATEMENT REGARDING FEDERALLY SPONSORED RESEARCH OR DEVELOPMENT

This invention was made with government support under Contract Number DE-AC07-05-ID14517 awarded by the United States Department of Energy. The government has certain rights in the invention.

TECHNICAL FIELD

This disclosure relates generally to modular forensic evidence collection systems and related methods.

BACKGROUND

Traditionally, conventional, radiological and nuclear evidence collection teams have two tools to collect particulates, hairs, fibers, radioactive particulates and nuclear fallout debris, a commercial hand-held vacuum cleaner (e.g., a conventional vacuum cleaner) and a brush and pan. However, smaller particles of conventional, radiological and nuclear materials (i.e., evidence) are typically missed utilizing conventional vacuum cleaners, and the vacuum cleaners become contaminated and/or damaged by the particles. Current approaches are also difficult to employ in wet environments, where water residue makes removal and separation of the evidence difficult to perform.

BRIEF SUMMARY

Some embodiments of the present disclosure include a modular particle collection system including a hollow lower member, a hollow upper member separably attached to the hollow lower member, a collection container separably attached to a longitudinal end of the hollow lower member opposite the hollow upper member, an inlet portion extending radially from the hollow lower member and configured to be fitted to a first portion of a vacuum system, and an outlet portion extending radially outward from the hollow upper member and configured to be fitted to a second portion of the vacuum system.

One or more embodiments of the present disclosure include a method of making a modular collection system. The method may include forming a hollow lower member, forming a hollow upper member, attaching the hollow upper member to the lower member, and attaching a collection container to a longitudinal end of the hollow lower member opposite the hollow upper member.

Some embodiments of the present disclosure include a modular particle collection system. The modular particle collection system may include a lower member including an outer wall defining a cylindrical interior, and a lip formed at a longitudinal end of the lower member, the outer wall and lip forming a recess therebetween. The modular particle collection system may further include an upper member separably attachable to the lower member, a collection container having a longitudinal end inserted into the recess defined between the outer wall and lip of the lower member and separably attachable to the lower member, an inlet portion extending radially from the lower member and configured to be fitted to a first portion of a vacuum system, an outlet portion extending radially outward from the upper member and configured to be fitted to a second portion of vacuum system, an inlet aperture extending through the inlet portion and into an interior of the lower member, and at least one flap member disposed over an interface of the inlet aperture and the interior of the lower member.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein.

DETAILED DESCRIPTION

Figure 1:
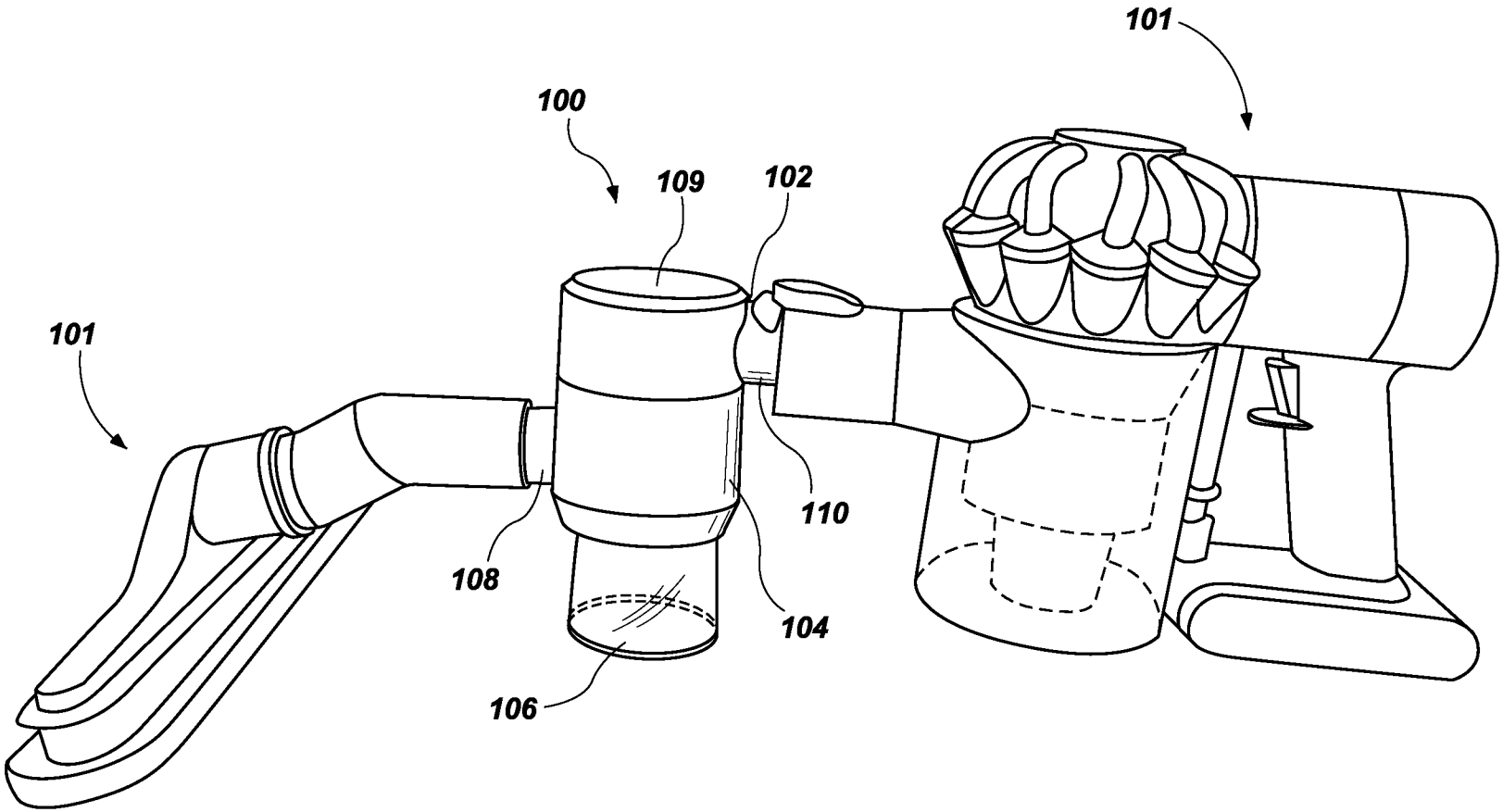
FIG. 1 is a perspective view of a modular particle collection system attached to a vacuum system according to one or more embodiments of the present disclosure.

The illustrations presented herein are not actual views of any modular particle collection system or any component thereof, but are merely idealized representations, which are employed to describe the present invention.

As used herein, any relational term, such as "first," "second," "top," "bottom," "upper," "lower," "side," etc., is used for clarity and convenience in understanding the disclosure and accompanying drawings, and does not connote or depend on any specific preference or order, except where the context clearly indicates otherwise. For example, these terms may refer to an orientation of elements of a modular particle collection system when attached to a vacuum system and utilized in a conventional manner. Furthermore, these terms may refer to an orientation of elements of a modular particle collection system when as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

FIG. 1 is a perspective view of a modular particle collection system 100 according to one or more embodiments of the present disclosure. As shown the modular particle collection system 100 may be disposed between two portions (e.g., a suction portion and an attachment portion) of a vacuum system 101. The modular particle collection system 100 may be utilized for collecting forensics evidence (e.g., nuclear forensics evidence) from the fallout debris that may be present after the detonation of a nuclear explosive device (e.g., a bomb). For instance, the modular particle collection system 100 may effectively and efficiently collect particulate (i.e., particles) having minimal sizes from about 1.0 micron to about 3.0 microns, while simultaneously collecting large-size particles having sizes from about 5.0 mm to about 10.0 mm. In additional embodiments, the modular particle collection system 100 may effectively and efficiently collect particulate (i.e., particles) having sizes from about 1.0 micron to about 5 mm, while simultaneously collecting large-size particles having sizes from about 5.0 mm to about 10.0 mm. Additionally, the modular particle collection system 100 may collect the foregoing-described particles under wet and dry conditions. Moreover, the modular particle collection system 100 may prevent collected materials from escaping out of (e.g., unintentionally leaving) the system when in use and/or when not in use.

Figure 2:
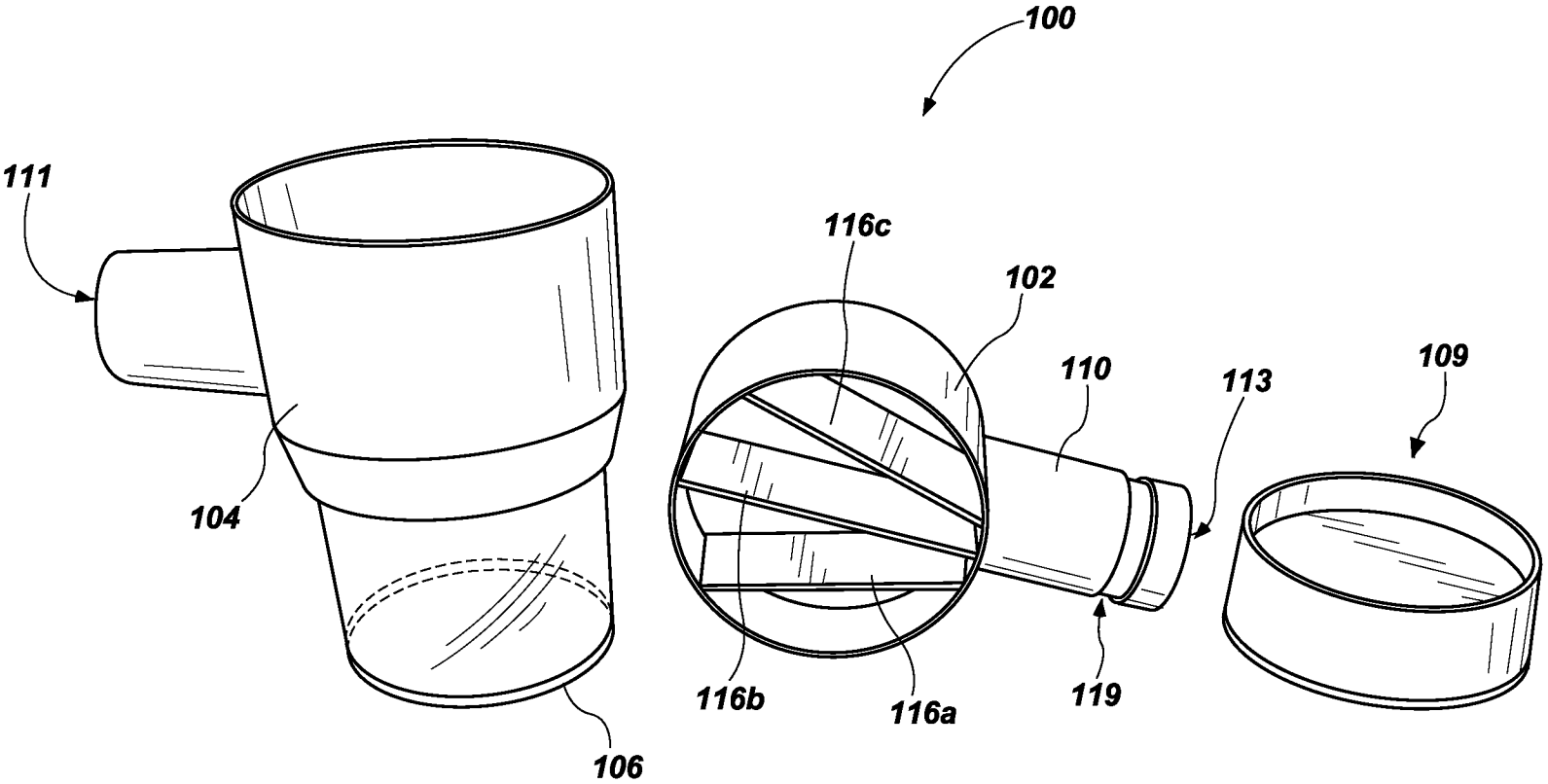
FIG. 2 is perspective view of a disassembled modular particle collection system according to one or more embodiments of the present disclosure.

As shown in FIG. 1, the modular particle collection system 100 may include a substantially hollow upper member 102 (i.e., upper member, upper plenum). The upper member 102 may include an inlet portion 108 and an outlet portion 110. Additionally, as is discussed in further detail below in regard to FIGS. 5 and 6, the modular particle collection system 100 may include one or more filters disposed therein. FIG. 2 is a perspective view of the modular particle collection system 100 disassembled to better show particular features of the modular particle collection system 100 according to one or more embodiments of the disclosure. Referring to FIGS. 1 and 2 together, the upper member 102 may fit at least partially within a hollow lower member 104 (i.e., lower member), for instance, an outer wall of the upper member 102 when inserted into a cavity defined the lower member 104 may be concentric with an outer wall of the lower member 104. Accordingly, at least a portion of the upper member 102 may be insertable into the lower member 104. As will be described in greater detail below in regard to FIG. 5, in some instances, a filter may be disposed between the upper member 102 and the lower member 104 (e.g., at an interface between the upper member 102 and the lower member 104) of the modular particle collection system 100.

In one or more embodiments, each of the upper member 102 and the lower member 104 may have a general hollow cylindrical shape. In some embodiments, a bottom portion (e.g., bottom end) of the upper member 102 may be tapered proximate the interface between the upper member 102 and the lower member 104 to enable relatively easy insertion of the upper member 102 into the lower member 104. In one or more embodiments, the bottom portion of the upper member 102 may include a threaded portion and an upper portion of the lower member 104 may include a correlating threaded portion on which the threaded portion of the upper member 102 may be threaded. In additional embodiments, the bottom portion of the upper member 102 may form a friction (e.g., press) connection with the upper portion of the lower member 104. For instance, an inner diameter of a wall defining the lower member 104 may be larger than an outer diameter of a wall defining the upper member 102 such that the upper member 102 may be insertable into the lower member 104.

In one or more embodiments, the lower member 104 may include an open top longitudinal end, and the upper member 102 may include an open bottom longitudinal end such that, when the upper member 102 and the lower member 104 are assembled together, an interior of (i.e., a first cavity defined by) the lower member 104 is connected to an interior of (i.e., a second cavity defined by) the upper member 102. As a result, the interiors of the upper and lower members 102, 104 may be in fluid communication with each other when the upper and lower members 102, 104 are assembled together, as depicted in FIG. 1.

In some embodiments, the upper member 102 may have a cap portion 109 capping a longitudinal end of the upper member 102 opposite the lower member 104 of the modular particle collection system 100. In one or more embodiments, the cap portion 109 may be integral to the upper member 102 (e.g., may form a single piece with the upper member 102). In other embodiments, the cap portion 109 may be a distinct attachment to the upper member 102.

The collection container 106 may be separably attachable to a longitudinal end of the lower member 104 opposite the upper member 102. For instance, the collection container 106 may have a threaded portion that may be threaded into and/or onto a threaded portion of the lower member 104. Furthermore, an interior of the collection container 106 may be open to (e.g., connected to) the interior of the lower member 104 such that particles brought into the lower member 104 (via airflow caused by the vacuum system 101) may fall into the collection container 106, as is described in greater detail below.

The inlet portion 108 may be attached to the lower member 104 and may extend radially from the lower member 104 (e.g., radially from a center longitudinal axis of the lower member 104). In some embodiments, the inlet portion 108 may be tapered in a direction extending from the lower member 104 to a distal end of the inlet portion 108. For instance, the inlet portion 108 may be tapered such that the inlet portion 108 may be inserted into an attachment portion of a vacuum system 101 (e.g., a fitting of a vacuum system 101). For example, the inlet portion 108 may be insertable into any conventional vacuum fitting. The inlet portion 108 may have an inlet aperture 111 extending therethrough along a central longitudinal axis of the inlet portion 108, and the inlet aperture 111 may extend to an interior of the lower member 104. In other words, the inlet aperture 111 of the inlet portion 108 may be in fluid communication with in the interior of the lower member 104. In some embodiments, the inlet portion 108 may be integral to the lower member 104 (e.g., may form a single piece with the lower member 104). In other embodiments, the inlet portion 108 may be a distinct attachment to the lower member 104. The inlet portion 108 is described in greater detail below in regard FIGS. 3 and 4.

The outlet portion 110 may be attached to the upper member 102 and may extend radially from the upper member 102. In one or more embodiments, the outlet portion 110 may be sized and shaped to attach (e.g., be fitted to) to a body portion of the vacuum system 101 (i.e., a portion of the vacuum system 101 configured to generate suction and drive operation of the vacuum system 101). The outlet portion 110 may have an outlet aperture 113 extending therethrough along a central longitudinal axis of the outlet portion 110, and the outlet aperture 113 may extend to an interior of the upper member 102. In other words, the outlet aperture 113 of the outlet portion 110 may be in fluid communication with in the interior of the upper member 102. In some embodiments, the outlet portion 110 may be integral to the upper member 102 (e.g., may formed a single piece with the upper member 102). In other embodiments, the outlet portion 110 may be a distinct attachment to the upper member 102. The outlet portion 110 is described in further detail in regard to FIG. 2.

In some embodiments, the upper member 102 may include a plurality of guide members 116*a*, 116*b*, 116*c* disposed within the interior of the upper member 102 and extending from one lateral side of an internal cylindrical surface of the upper member 102 to an opposite lateral side of the internal cylindrical surface of the upper member 102. In one or more embodiments, each guide member of the plurality of guide members 116*a*, 116*b*, 116*c* may include an at least substantially planar fin. In some embodiments, longitudinal ends of the plurality of guide members 116*a*, 116*b*, 116*c* may converge relative to one another on a lateral side of the upper member 102 proximate to the outlet portion 110 of the modular particle collection system 100 and may diverge relative to one another on a lateral side of the upper member 102 proximate to the inlet portion 108 of the modular particle collection system 100.

The plurality of guide members 116*a*, 116*b*, 116*c* may be oriented and designed to guide airflow and particle flow from the inlet portion 108 of the modular particle collection system 100 to the outlet portion 110 of the modular particle collection system 100. In some embodiments, the plurality of guide members 116*a*, 116*b*, 116*c* may include at least three guide members. In additional embodiments, the plurality of guide members 116*a*, 116*b*, 116*c* may include at least five or more guide members. In some embodiments, a number of guide members may be at least partially dependent on a size of particles to be collected by the modular particle collection system 100. For instance, the larger the particle, the fewer number of guide members may be included within the modular particle collection system 100.

Referring still to FIGS. 1 and 2 together, in one or more embodiments, the outlet portion 110 may include an at least substantially annular recess 119 on a distal end of the outlet portion 110 (e.g., a portion of the outlet portion 110 intended to connect to a body of a vacuum system 101). The annular recess 119 may be sized and shaped to receive a retention ring (not shown) for retaining the outlet portion 110 of the modular particle collection system 100 to the body of the vacuum system 101. In additional embodiments, the outlet portion 110 may be tapered in a direction extending from the upper member 102 to a distal end of the outlet portion 110. For instance, the outlet portion 110 may be tapered such that the outlet portion 110 may be inserted into an attachment of a body portion of a vacuum system 101. For example, the inlet portion 108 may be attachable to any conventional body of a vacuum system 101.

In some embodiments, one or more of the upper member 102, the lower member 104, the inlet portion 108, and the outlet portion may be formed via an additive manufacturing process (i.e., 3D printing). For instance, the upper member 102, the lower member 104, the inlet portion 108, and the outlet portion 110 can be formed via any suitable additive manufacturing processes known in the art. As a non-limiting example, in one or more embodiments, the upper member 102, the lower member 104, the inlet portion 108, and the outlet portion 110 may be formed via fused deposition modeling. In other embodiments, the upper member 102, the lower member 104, the inlet portion 108, and the outlet portion 110 can be formed via one or more additive manufacturing processes, such as, for example, direct metal deposition, micro-plasma powder deposition, direct laser sintering, selective laser sintering, electron beam melting, electron beam freeform fabrication, inkjet 3D printing, and other additive manufacturing process. In yet further embodiments, the upper member 102, the lower member 104, the inlet portion 108, and the outlet portion 110 can be formed via injection molding.

Figure 3:
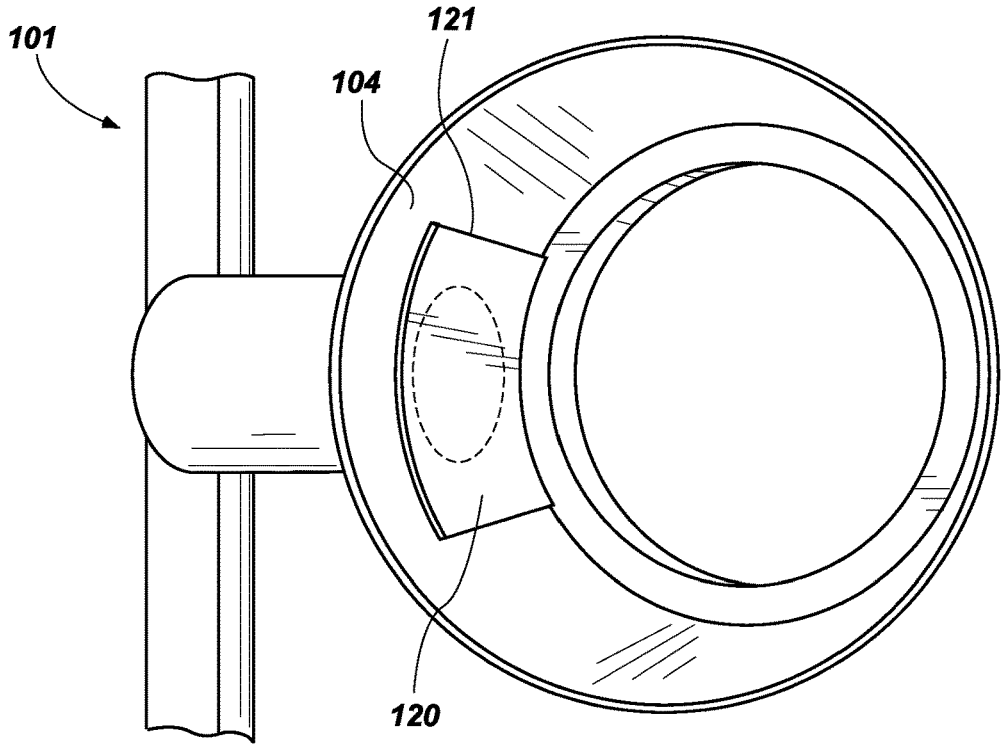
FIG. 3 is a perspective view of a lower member of the modular particle collection system according to one or more embodiments of the present disclosure.
Figure 4A:
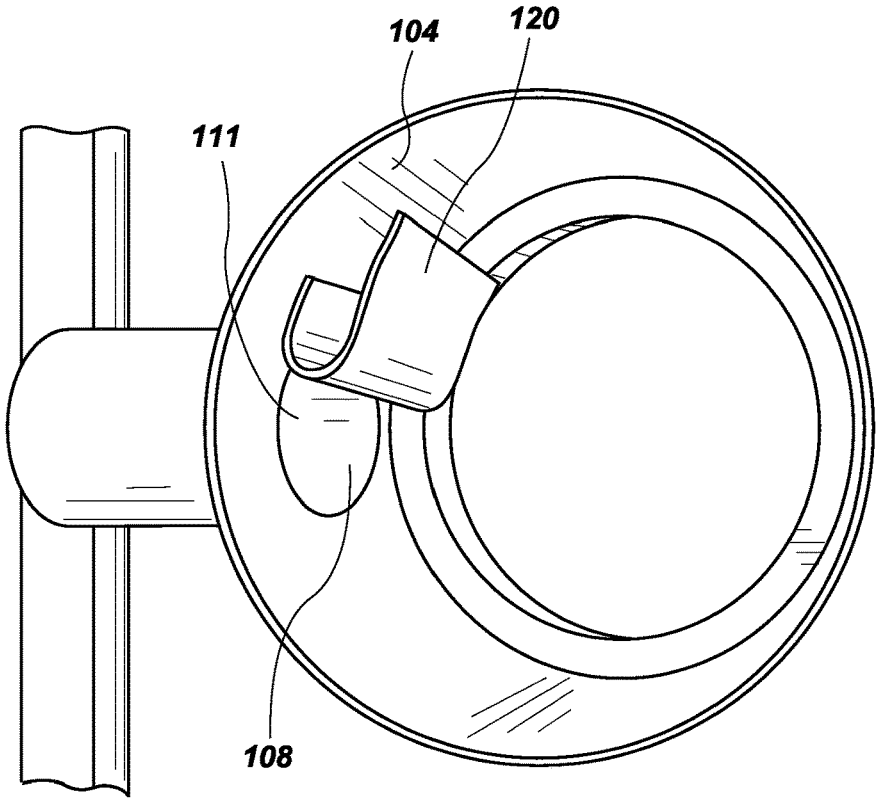
FIG. 4A is another perspective view of a lower member of the modular particle collection system according to one or more embodiments of the present disclosure.

FIG. 3 is a partial view of the lower member 104 of the modular particle collection system 100. FIG. 4A is another partial view of the lower member 104 the modular particle collection system 100 according to one or more embodiments. Referring to FIGS. 3 and 4A together, in one or more embodiments, the modular particle collection system 100 may include at least one flap member 120 (e.g., a cyclone flap) disposed over an interface between the inlet aperture 111 extending through the inlet portion 108 of the modular particle collection system 100 and the interior of the lower member 104 of the modular particle collection system 100.

In some embodiments, the flap member 120 may have a general rectangle shape and may be secured to an interior wall of the lower member 104 along one side edge 121 of the flap member 120. The one side edge 121 of the flap member 120 may extend in a vertical direction along an interior wall of the lower member 104. As a result, an opposite side edge the flap member 120 may separate from the interior wall of the lower member 104 when opened. In one or more embodiments, the flap member 120 may be secured to the interior wall of the lower member 104 with one or more fasteners and/or adhesive. Furthermore, the flap member 120 may include a flexible material such that the flap member 120 can flex (e.g., bend, deform, etc.) when the modular particle collection system 100 is in use (due to airflow through the inlet portion 108 and lower member 104 caused by suction created by vacuum system 101). For instance, the flap member 120 may include one or more of a polymer material, a rubber material, or a mesh material.

Because the flap member 120 opens along a side edge of the flap member 120 as opposed to an upper edge or lower edge and because the lower member 104 has a cylindrical-shaped interior, the flap member 120 may induce rotational airflow (e.g., cyclonic airflow) within the interior of the lower member 104 of the modular particle collection system 100 when the modular particle collection system 100 is in use. Furthermore, when the modular particle collection system 100 is utilized to collect particles (e.g., suck up particles), the flap member 120 may also prevent direct impact of particles into any filter included within the modular particle collection system 100 (described below in regard to FIGS. 5 and 6). In operation, the cyclonic airflow caused by the flap member 120 separates relatively larger particles from relatively smaller (i.e., fine) particles, thereby enables the modular particle collection system 100 to capture at least substantially all of the particles. For instance, relatively larger particles are captured within the collection container 106, and the relatively smaller particles are captured within any filter included within the modular particle collection system 100 (described below in regard to FIGS. 5 and 6). Therefore, the modular particle collection system 100 of the present disclosure eliminates any need to remove particles from the vacuum system 101 by hand and transfer the particles to an evidence container, as is typically necessary with conventional particle collection systems, because the particles are already collected within the collection container 106 and/or the filter.

Figure 4B:
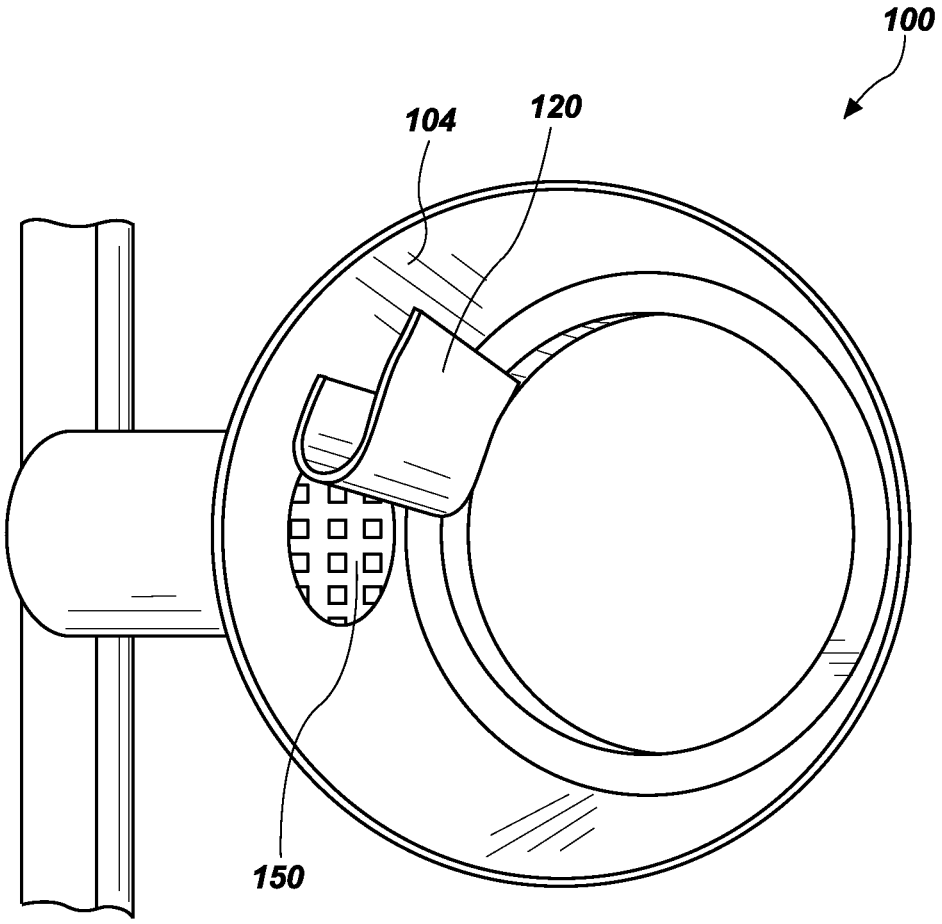
FIG. 4B is a perspective view of a lower member of the modular particle collection system according to one or more embodiments of the present disclosure.

Referring to FIG. 4B, in some embodiments, the modular particle collection system 100 may further include a mesh structure 150. In some embodiments, the mesh structure 150 may be disposed under the flap member 120 to prevent relatively larger particles from entering the lower member 104 of the modular particle collection system 100 through the inlet portion 108. In additional embodiments, the mesh structure 150 may be oriented in front of the filter 122 (FIG. 6) in a direction of air flow during use and may prevent relatively larger particles from contacting the filter 122 (FIG. 6) (e.g., may protect the filter 122 (FIG. 6)). In yet further embodiments, the mesh structure 150 may be oriented behind the filter 122 (FIG. 6) in a direction of air flow during use and may provide a rigid support for the filter 122 (FIG. 6) to substantially prevent tearing and/or ripping of the filter 122.

Figure 6:
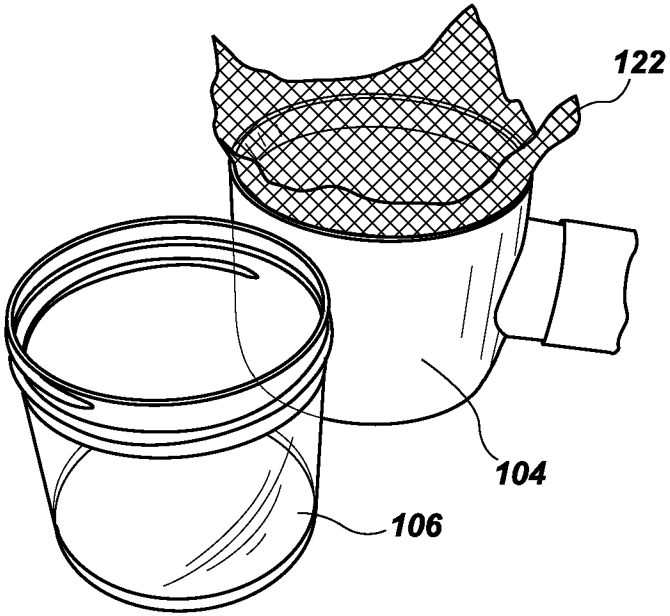
FIG. 6 is another perspective view of a lower member of the modular particle collection system having a filter disposed therein, and a collection container of the modular particle collection system according to one or more embodiments of the present disclosure.
Figure 5:
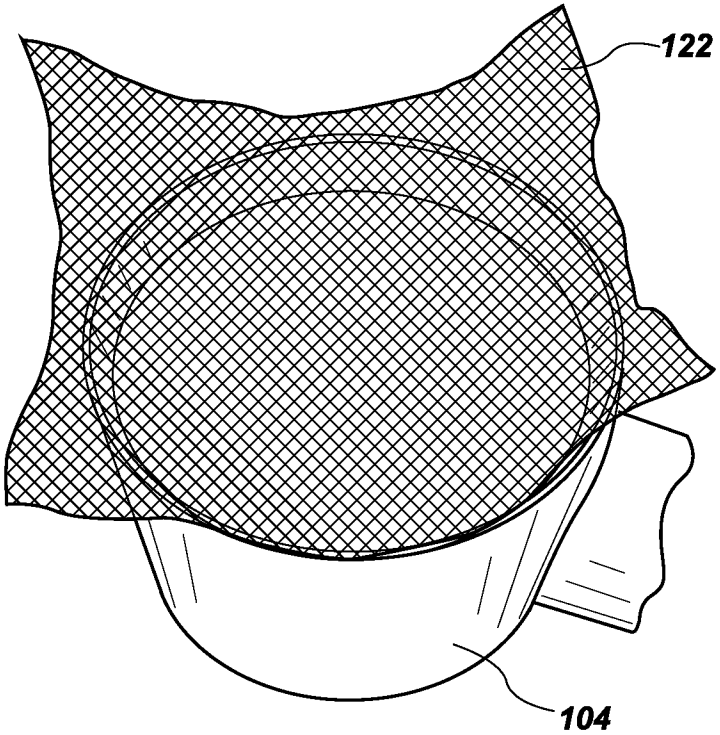
FIG. 5 is a perspective view of a lower member of the modular particle collection system having a filter disposed therein according to one or more embodiments of the present disclosure.

FIG. 5 shows a perspective view of the lower member 104 of the modular particle collection system 100 including a filter 122 attached thereto according to one or more embodiments of the present disclosure. FIG. 6 shows another perspective view of the lower member 104 of the modular particle collection system 100 and the collection container 106 according to embodiments of the present disclosure. Referring to FIGS. 5 and 6 together, in one or more embodiments, the filter 122 may extend across the interior of the lower member 104 and, as mentioned above, may be disposed between the lower member 104 and the upper member 102 of the modular particle collection system 100 at an interface of the lower member 104 and the upper member 102 when assembled together. Due to the mechanical connection between the lower member 104 and the upper member 102, the modular particle collection system 100 may firmly hold the filter 122 in place when the modular particle collection system 100 is in use. In one or more embodiments, the filter 122 may be at least partially held in place via one or more filter rings disposed within the interior and/or on an exterior of the lower member 104 and/or the upper member 102.

In some embodiments, the filter 122 may include a water-resistant air filter. In some instances, the filter 122 may include a mesh filter designed to capture certain sizes of particles. In further embodiments, the filter 122 may include a HEPA filter. In some embodiments, the filter 122 may include multiple stacked filters (i.e., multiple filters in parallel with each other) where each filter 122 of the multiple stacked filters is designed to capture a different size of particle. In one or more embodiments, the filter 122 may include one or more regions of differing types of filter material. For instance, one region of the filter 122 may be configured to filter out large particles and another region of the filter 122 may be configured to filter out small particles. In further embodiments, the modular particle collection system 100 may include a relatively coarse mesh material preceding the filter 122 (e.g., in a direction of airflow through the modular particle collection system 100) to protect the filter 122 from relatively larger debris. Furthermore, in some embodiments, the modular particle collection system 100 may include a first flap member at the inlet portion 108 (described above) and a second flap member at the outlet portion 110; e.g., within the outlet aperture 113. The dual flap members may prevent fluids (in a wet environment) or particles from escaping the modular particle collection system 100 when being handled during and outside of use.

In view of the foregoing, parts (e.g., the upper and lower members 102, 104, the filter 122, the collection container 106, etc.) of the modular particle collection system 100 may be mixed and matched, allowing an operator to stock spare parts as needed to accomplish a particular task (e.g., clean up radiated particles). Furthermore, due to parts of the modular particle collection system 100 being 3D printed, as described above, the modular particle collection system 100 may be mass produced via injection molding.

Moreover, the modular particle collection system 100 permits the use of different upper members to enable attachment to and use of different vacuum systems. Moreover, the modular particle collection system 100 permits the use of different lower members to enable attachment to and use of different vacuum attachments (e.g., wands, brushes, squeegees). Additionally, enabling different lower members enables the modular particle collection system 100 to accommodate different sizes and/or types of collection containers. In some embodiments, the modular particle collection system 100 may be attachable to conventional (e.g., commercial) vacuum systems.

The modular particle collection system 100 may also include the following features and/or elements. The collection container 106 may include an evidence collection sample jar, which eliminates loss of fine powder particles due to static electricity within the vacuum system 101.

Referring to FIGS. 1-6 together, in operation, the body of the vacuum system 101 may generate suction via conventional methods. Generating suction within the body of the vacuum system 101 may cause airflow into the inlet portion 108 of the lower member 104 of the modular particle collection system 100 (e.g., into the inlet portion 108 of the lower member through a vacuum fitting attached to the inlet portion). Furthermore, the airflow may pass through the inlet aperture 111 extending through the inlet portion 108 and may cause the flap member 120 to bend (e.g., deform) to permit the airflow to enter the interior of the lower member 104. As discussed above, due to the manner in which the flap member 120 opens, the flap member 120 may induce rotational airflow (e.g., cyclonic airflow) within the interior of the lower member 104 of the modular particle collection system 100. The cyclonic airflow may separate relatively larger particles from relatively smaller (i.e., fine) particles. For instance, the cyclonic airflow may drop relatively larger particles into the collection container 106 and may keep relatively smaller particles within the cyclonic airflow.

The airflow may pass through the filter 122, and the relatively smaller particles may be captured within the filter 122 of the modular particle collection system 100. The airflow may pass into the interior of the upper member 102. Furthermore, the plurality of guide members 116*a*, 116*b*, 116*c* within the upper member 102 may at least substantially evenly distribute the airflow across the filter 122 to maximize collection while minimizing filter 122 clogging. Furthermore, as noted above, the plurality of guide members 116*a*, 116*b*, 116*c* may guide airflow toward the outlet portion 110 of the modular particle collection system 100. The airflow may pass through the outlet portion 110 and into the body of the vacuum system 101 where the airflow may be distributed from the vacuum system 101 via conventional manners.

Figure 7:
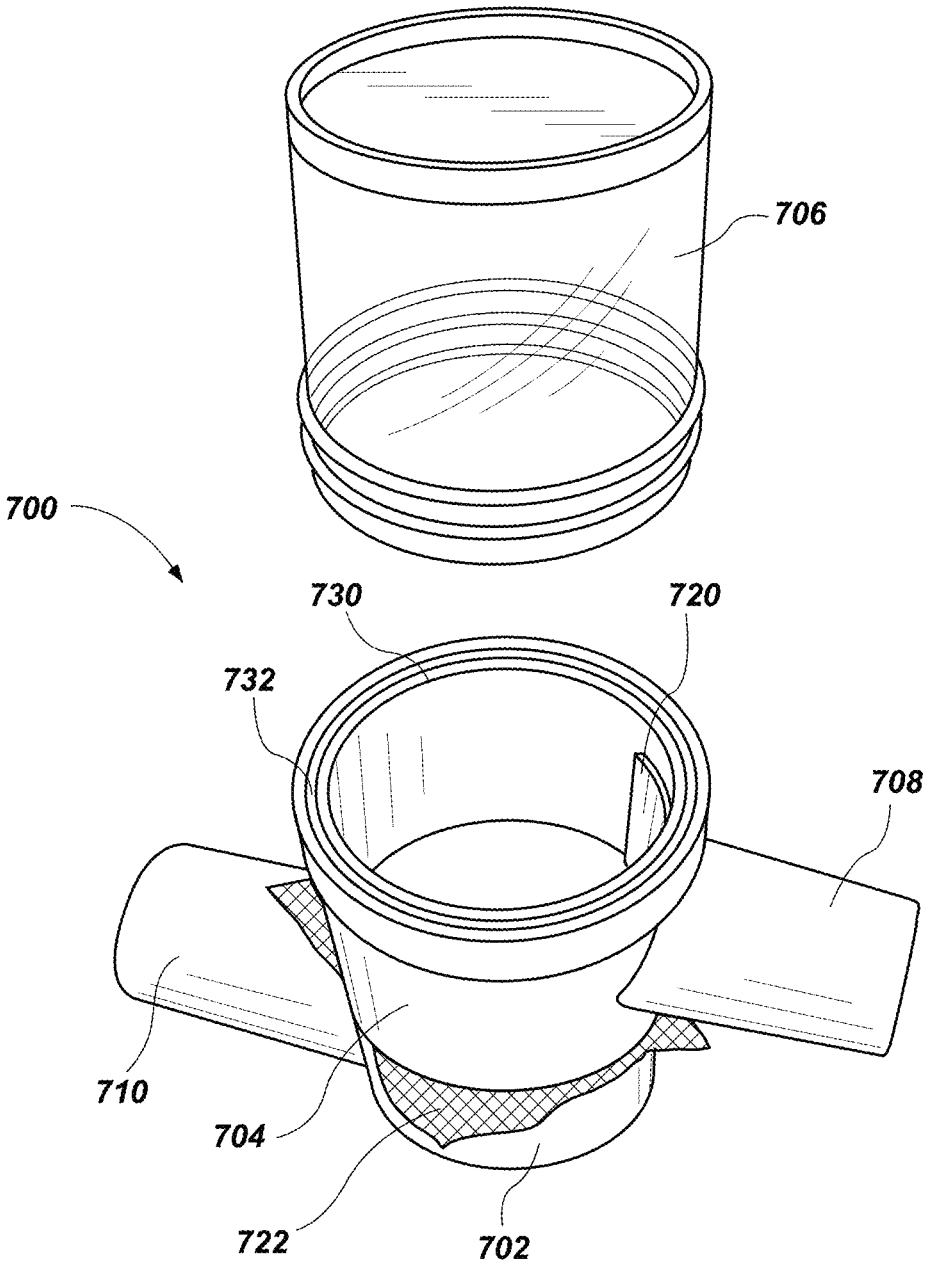
FIG. 7 is a perspective view of an upper member and a lower member of a modular particle collection system according to one or more embodiments of the present disclosure.

FIG. 7 is a bottom perspective view of modular particle collection system 700 according to one or more additional embodiments of the present disclosure. Similar to the modular particle collection system 100 described above in regard to FIGS. 1-6, the modular particle collection system 700 may include an upper member 702, a lower member 704, a collection container 706, an inlet portion 708, an outlet portion 710, a flap member 720, and a filter 722. Furthermore, the modular particle collection system 700 may include a lip 730 formed within an interior of the lower member 704 at the lower longitudinal end of the lower member 704 where in the collection container 706 is configured to connect to the lower member 704. In some embodiments, the lip 730 and an outer wall of the lower member 704 may define a gap 732 therebetween. Furthermore, at least a portion of the collection container 706 may be insertable into the gap 732 when attached to the lower member 704. In particular, the collection container 706 may be connected to the lower member 704 by inserting an upper end of the collection container 706 into the gap 732 between the lip 730 and the outer wall of the lower member 704. As a result, the lip 730 may extend at least partially into an interior of the collection container 706. Furthermore, because the lip 730 extends at least partially into the interior of the collection container 706, the lip 730 may guide particles into the collection container 706 and may reduce a likelihood that particles get caught (e.g., stuck) at an interface of the lower member 704 and the collection container 706.

Figure 8:
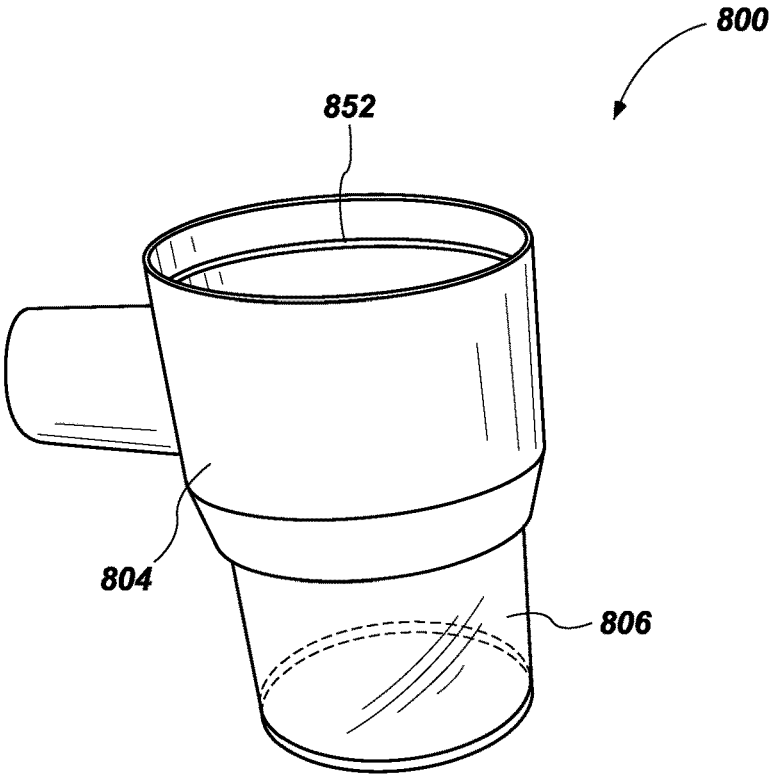
FIG. 8 is a perspective view of a lower member and a collection container of a modular particle collection system according to one or more embodiments of the disclosure.
Figure 9:
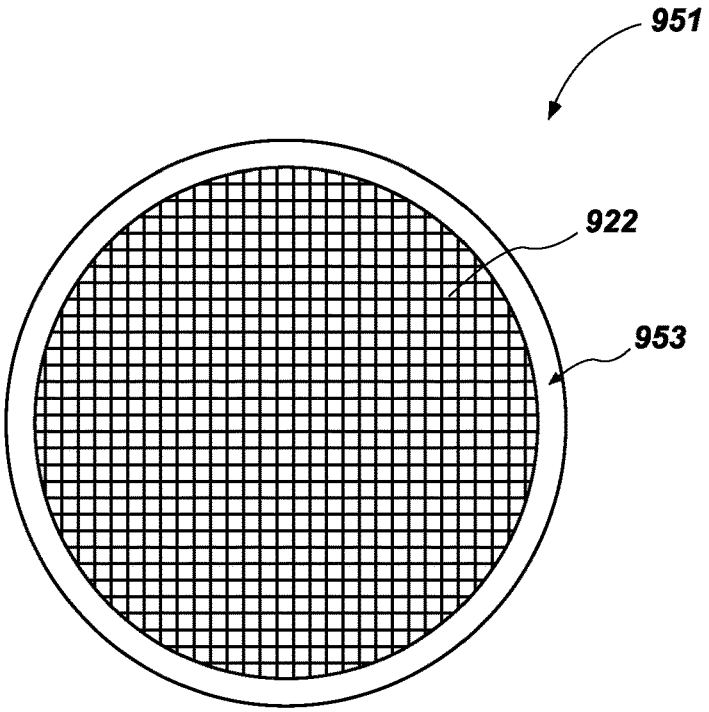
FIG. 9 is a side view of a filter assembly according to one or more embodiments of the disclosure.

FIG. 8 is a perspective view of a lower member 804 and a collection container 806 of a modular particle collection system 800 according to one or more embodiments of the disclosure. FIG. 9 is a side view of a filter assembly 951 according to one or more embodiments of the disclosure. Referring to FIGS. 8 and 9 together, in some embodiments, the lower member 804 may include one or more protrusions 852 extending radially inward from an interior wall of the lower member 804. In some embodiments, the one or more protrusions 852 may include an annular protrusion or a plurality of protrusion segments oriented relative to one another in an annular orientation. As is described in further detail below, the one or more protrusions 852 may act as a rest and/or support surface for the filter assembly 951. The filter assembly 951 may include a filter 922 and an outer frame 953. The filter 922 may be secured to the outer frame 953 (e.g., via an adhesive), and the outer frame 953 may support the filter 922. In some embodiments, the outer frame 953 may have an annular shape. In operation, the filter assembly 951 may be disposed within the lower member 804 and may rest upon and be at least partially held in place by the one or more protrusions 852. Additionally, the outer frame 953 may serve as a seal between a lower member and an upper member.

Referring to FIGS. 1-9 together, although the upper members 102, 702, the lower members 104, 704, 804, and the collection containers 106, 706, 806 are shown as having cylindrical shapes, the disclosure is not so limited. Rather, any of the upper members 102, 702, the lower members 104, 704, 804, and the collection containers 106, 706, 806 may have other shapes (e.g., cubic, rectangular prism, elliptic cylindrical shapes). Furthermore, while the upper members 102, 702, and the lower members 104, 704, 804 are shown and described as being connected together via a press fit, the disclosure is not so limited. Rather, upper members may be connected be connected to lower members via one or more of threaded connections, adhesives, clamps, latches, or any other connection structures.

EXAMPLES

The following examples include experimental procedures performed by the inventors and results obtained by the inventors in regard to the above-described modular particle collection system. The following experiments were performed to assess the performance of the modular particle collection system for collecting powder from a surface. The powder was made using Sol-Gel methods and incorporating scandium. Five samples were produced, each weighing 0.5 g. The samples were packaged in quartz vials; and the samples were irradiated using high-energy bremsstrahlung.

The irradiation conditions and time of irradiation for each vial were different. For ease of explanation, the total activity of each vial was determined for a fictitious Zero Time (T+0). The total activity in a vial at time T+t was a function of the starting amount of ground-state $^{44}$Sc in the vial, $A_g^0$, and the starting amount of metastable-state $^{44m}$Sc in the vial, $A_m^0$. These values have been calculated to correspond with zero time, and can be used in Eq. 1, along with values for the decay constants of these two isotopes, to determine the total scandium activity in the vials at a time, t, after time zero. Parameter values for $A_g^0$ and $A_m^0$ for zero time for each of the five vials are shown in Table 1.

$$A(t) = A_m^0 e^{-\lambda_m t} + A_g^0 e^{-\lambda_g t} + \frac{\lambda_g}{\lambda_g - \lambda_m} A_m^0 \left(e^{-\lambda_m t} - e^{-\lambda_g t}\right) \quad \text{Eq. 1}$$

TABLE 1

Time-zero activity parameters for five vials of scandium-doped sol-gel glass.

| Vial Number | $A_g^0$, $s^{-1}$ | $A_m^0$, $s^{-1}$ |
|---|---|---|
| 1 | 269,043 | 3,200 |
| 2 | 209,562 | 2,302 |
| 3 | 150,973 | 2,096 |
| 4 | 101,653 | 1,294 |
| 5 | 99,268 | 1,365 |

At different stages in each experiment the radioactivity of materials was assessed using a well counter assembled using 2 in ×4 in ×16 in NaI scintillation detectors and conventional electronics and data acquisition equipment. Background measurements were taken at the start of each experiment cycle; the total background changed by ~3% over the course of the experiments. Measurements were then taken of Sc-containing items using the whole gamma-ray spectrum, and then background was subtracted to generate a total number of counts. Each measurement was performed for 300 live-time seconds. A brief summary of the procedure of each experiment is provided herein. The results are provided below in Table 2.

Experiment 1: This experiment involved vacuuming the above-described powder from an aluminum plate, PLATE #1. PLATE #1 was 1 m×1 m in area; prior to the experiment, the plate's surface was roughly sanded using a 220-grit jitter-bug orbital sander. Vial #1 was used as a starting material. The following explanation includes the steps taken in Experiment 1.

a) MEASUREMENT: Background.
b) MEASUREMENT: Vial #1/FULL in a plastic jar.
c) ACTION: Vial #1/FULL was emptied into a jar (JAR #1.0/FULL).
d) MEASUREMENT: Vial #1/EMPTY in a plastic jar.

e) MEASUREMENT: JAR #1.0/FULL.
f) CALCULATION: The amount of residual material left in Vial #1 was determined.
g) CALCULATION: The amount of material in JAR #1.0/FULL was determined.
h) ACTION: JAR #1.0/FULL was emptied on to the plate.
i) MEASUREMENT: JAR #1.0/EMPTY.
j) ACTION: The powder was vacuumed from the plate using a 10 micron filter at the interface of an upper member and a lower member of the modular particle collection system.
k) MEASUREMENT: JAR #1.1 (i.e., the collection container).
l) CALCULATION: The amount of material in JAR #1.1.
m) MEASUREMENT: filter #1.1 in a jar.
n) CALCULATION: The amount of material in filter #1.1.
o) MEASUREMENT: UPPER PLENUM #1.1 (i.e., upper member).
p) CALCULATION: The amount of material in UPPER PLENUM #1.1 (i.e., upper member).
q) ACTION: Second round of vacuuming, using a second jar, a 15 micron filter at the interface of an upper member and a lower member of the modular particle collection system and reusing the same upper plenum (i.e., upper member).
r) MEASUREMENT: JAR #1.2.
s) CALCULATION: The amount of material in JAR #1.2.
t) MEASUREMENT: filter #1.2.
u) CALCULATION: The amount of material in filter #1.2.

Experiment 2: This experiment used Vial #2 and PLATE #2, which was the same as PLATE #1, but otherwise was a duplicate of Experiment 1.

Experiment 3: This experiment used Vial #3 and PLATE #3, which was the same as PLATE #1. Experiment 3 was similar to Experiments 1 and # but a) only used a 15 micron filter at the interface of an upper member and a lower member of the modular particle collection system, b) only had one session of vacuuming, and c) did not include making an upper plenum measurement.

a) MEASUREMENT: Background.
b) MEASUREMENT: Vial #3/FULL in a plastic jar.
c) ACTION: Vial #3/FULL was emptied into a jar (JAR #3.0/FULL).
d) MEASUREMENT: Vial #3/EMPTY in a plastic jar.
e) MEASUREMENT: JAR #3.0/FULL.
f) CALCULATION: The amount of residual material left in Vial #3 was determined.
g) CALCULATION: The amount of material in JAR #3.0/FULL was determined.
h) ACTION: JAR #3.0/FULL was emptied on to the plate.
i) MEASUREMENT: JAR #3.0/EMPTY.
j) ACTION: The powder was vacuumed from the plate using a 15 micron filter at the interface of an upper member and a lower member of the modular particle collection system.
k) MEASUREMENT: JAR #3.1 (i.e., the collection container).
l) CALCULATION: The amount of material in JAR #3.1.
m) MEASUREMENT: filter #3.1 in a jar.
n) CALCULATION: The amount of material in filter #3.1.

Experiment 4: This experiment reused PLATE #3, which was cleaned and wiped following Experiment 3. As starting material it used Vial #4. It was similar to experiments #1 and #2 but a) only used a 15 micron filter and b) only had one round of vacuuming.

a) MEASUREMENT: Background.
b) MEASUREMENT: Vial #4/FULL in a plastic jar.
c) ACTION: Vial #4/FULL was emptied into a jar (JAR #4.0/FULL).
d) MEASUREMENT: Vial #4/EMPTY in a plastic jar.
e) MEASUREMENT: JAR #4.0/FULL.
f) CALCULATION: The amount of residual material left in Vial #4 was determined.
g) CALCULATION: The amount of material in JAR #4.0/FULL was determined.
h) ACTION: JAR #4.0/FULL was emptied on to the plate.
i) MEASUREMENT: JAR #4.0/EMPTY.
j) ACTION: The powder was vacuumed from the plate using a 15 micron filter at the interface of an upper member and a lower member of the modular particle collection system.
k) MEASUREMENT: JAR #4.1 (i.e., the collection container).
l) CALCULATION: The amount of material in JAR #4.1.
m) MEASUREMENT: filter #4.1 in a jar.
n) CALCULATION: The amount of material in filter #4.1.
o) MEASUREMENT: UPPER PLENUM #4.1 (i.e., upper member).
p) CALCULATION: The amount of material in UPPER PLENUM #4.1 (i.e., upper member).

Experiment 5: This experiment involved vacuuming powder from an array of nine 12"×12" concrete paver tiles. As starting material it used Vial #5.

a) MEASUREMENT: Background.
b) MEASUREMENT: Vial #5/FULL in a plastic jar.
c) ACTION: Vial #4/FULL was emptied into a jar (JAR #5.0/FULL).
d) MEASUREMENT: Vial #5/EMPTY in a plastic jar.
e) MEASUREMENT: JAR #5.0/FULL.
f) CALCULATION: The amount of residual material left in Vial #4 was determined.
g) CALCULATION: The amount of material in JAR #5.0/FULL was determined.
h) ACTION: JAR #5.0/FULL was emptied on to the plate.
i) MEASUREMENT: JAR #5.0/EMPTY.
j) ACTION: The powder was vacuumed from the plate using a 15 micron filter at the interface of an upper member and a lower member of the modular particle collection system.
k) MEASUREMENT: JAR #5.1 (i.e., the collection container).
l) CALCULATION: The amount of material in JAR #5.1.
m) MEASUREMENT: filter #5.1 in a jar.
n) CALCULATION: The amount of material in filter #5.1.
o) MEASUREMENT: UPPER PLENUM #5.1 (i.e., upper member).
p) CALCULATION: The amount of material in UPPER PLENUM #5.1 (i.e., upper member).

The results for each experiment are summarized below in Table 2. All calculations accounted for decay from T+0 until the time a measurement started, no decay correction was applied for the 300-second live-time measurement period. Uncertainty values in the Table 2 are combined Type A, 1−σ uncertainties for the derived quantities. The Type A, 1−σ uncertainties may include uncertainties based on statistical analysis of a series of measurements (e.g., statistical data obtained from quality control results); Type B uncertainties were not assessed but are not expected to be greater than 1% for results reported with uncertainties. The Type B uncertainties are obtained by non-statistical procedures, such as, for example, information associated with authoritative published numerical quantity, information associated with the numerical quantity of a certified reference material, data obtained from a calibration certificate, information obtained from limits deduced through experience, and/or scientific judgment. No uncertainties are presented for mass values related to the filter or plenum measurements; the Type A uncertainties for the below measurements are less than 0.1%, but Type B uncertainties are unknown and not considered to be negligible (due to variable geometry and absorption). A reasonable bounding estimate for Type B uncertainties, as expanded uncertainties with a coverage factor, for these calculations would be ±10%.

TABLE 2

Time-zero activity parameters for five vials of scandium-doped sol-gel glass.

| Experiment No. | Mass Transferred to surface, (g) | Mass collected in jar(s), (g) | Fraction collected in Jar, % | Mass deposited in filter(s), (g) | Mass remaining in plenum, (g) |
|---|---|---|---|---|---|
| 1 | 0.466 ± 0.001 | 0.315 ± 0.016 | 67.6 ± 3.5 | 0.008 | 0.031 |
| 2 | 0.477 ± 0.001 | 0.308 ± 0.018 | 64.5 ± 3.8 | 0.016 | 0.014 |
| 3 | 0.455 ± 0.001 | 0.371 ± 0.016 | 81.5 ± 3.6 | 0.020 | Not measured |
| 4 | 0.460 ± 0.001 | 0.352 ± 0.020 | 76.6 ± 4.3 | 0.053 | 0.046 |
| 5 | 0.471 ± 0.001 | 0.150 ± 0.017 | 31.8 ± 3.6 | 0.020 | 0.035 |

Observations:

Emptying the vials has an efficiency of 95-97%.

Emptying the jars has an efficiency of 95-97%.

Vacuuming semi-rough aluminum with the prototype vacuum collection system yields a recoverable mass fraction of 72% with a standard deviation of 6%.

The mass of material collected in the filters from vacuuming the aluminum ranged from 2.5% to 15%; a comparable level of material was also left in the prototype's upper plenum (i.e., upper member).

For the sol-gel particles used in these trials, the 10 micron filter became clogged after cleaning approximately ⅓ $m^2$. The 15 micron filter did not become clogged after cleaning 1 $m^2$.

In conclusion, the modular particle collection system 100 studied in these examples exhibits an efficiency of about 72%±6%, which is significantly better rate of collection in comparison to conventional particle collection systems. Other embodiments of modular collections systems employing different implementations of the claims of this patent could be designed to achieve higher collection efficiencies.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A modular particle collection system, comprising:

a hollow lower member;

a hollow upper member separably attached to the hollow lower member, the hollow upper member including a plurality of guide members extending from one lateral side of the hollow upper member to an opposite lateral side of the hollow upper member, and the plurality of guide members converging relative to one another proximate to the one lateral side of the hollow upper member and diverging relative to one another proximate to the opposite lateral side of the hollow upper member;

a collection container separably attached to a longitudinal end of the hollow lower member opposite the hollow upper member;

an inlet portion extending radially from the hollow lower member and configured to be fitted to a first portion of a vacuum system; and an outlet portion extending radially outward from the hollow upper member and configured to be fitted to a second portion of the vacuum system.

2. The modular particle collection system of claim 1, further comprising at least one filter disposed at an interface of the hollow lower member and the hollow upper member.

3. The modular particle collection system of claim 2, wherein the at least one filter comprises a plurality of filters in parallel with each other.

4. The modular particle collection system of claim 3, wherein each filter of the plurality of filters is configured to capture a different size of particles.

5. The modular particle collection system of claim 1, wherein a portion of the hollow upper member disposed within the hollow lower member is tapered.

6. The modular particle collection system of claim 1, further comprising a cap portion capping a longitudinal end of the hollow upper member opposite the hollow lower member.

7. The modular particle collection system of claim 1, wherein the inlet portion is tapered in a direction extending radially from the hollow lower member.

8. The modular particle collection system of claim 1, wherein the collection container comprises a threaded portion for threading on to the hollow lower member.

9. The modular particle collection system of claim 1, wherein the outlet portion comprises an at least substantially annular recess configured to receive a retention ring for retaining the outlet portion to a body of the vacuum system.

10. The modular particle collection system of claim 1, further comprising:

an inlet aperture extending through the inlet portion and into an interior of the hollow lower member; and at least one flap member disposed over an interface of the inlet aperture and the interior of the hollow lower member.

11. The modular particle collection system of claim 10, wherein the at least one flap member is attached to an interior wall of the hollow lower member along on edge of the at least one flap member.

12. The modular particle collection system of claim 10, wherein the at least one flap member is configured to cause rotational airflow within the hollow lower member.

13. The modular particle collection system of claim 1, further comprising:

an outlet aperture extending through the outlet portion and into an interior of the hollow lower member.

14. The modular particle collection system of claim 1, wherein the hollow upper member, the hollow lower member, the inlet portion, and the outlet portion comprise additive manufacturing formed portions.

15. A method of making a modular particle collection system, the method comprising:

forming a hollow lower member;

forming a hollow upper member, the hollow upper member including a plurality of guide members extending from one lateral side of the hollow upper member to an opposite lateral side of the hollow upper member, and the plurality of guide members converging relative to one another proximate to the one lateral side of the hollow upper member and diverging relative to one another proximate to the opposite lateral side of the hollow upper member;

attaching the hollow upper member to the hollow lower member; and attaching a collection container to a longitudinal end of the hollow lower member opposite the hollow upper member.

16. The method of claim 15, further comprising disposing at least one filter at an interface of the hollow lower member and the hollow upper member.

17. The method of claim 15, further comprising attaching a flap member to an interior wall of the hollow lower member over an inlet portion of the hollow lower member.

18. A modular particle collection system, comprising:

a lower member comprising:

an outer wall defining a cylindrical interior; and a lip formed at a longitudinal end of the lower member, the outer wall and lip forming a recess therebetween;

an upper member separably attachable to the lower member;

a collection container having a longitudinal end configured to be inserted into the recess defined between the outer wall and lip of the lower member and separably attachable to the lower member;

an inlet portion extending radially from the lower member and configured to be fitted to a first portion of a vacuum system;

an outlet portion extending radially outward from the upper member and configured to be fitted to a second portion of vacuum system;

an inlet aperture extending through the inlet portion and into an interior of the lower member; and at least one flap member disposed over an interface of the inlet aperture and the interior of the lower member.

* * * * *